US005460215A

United States Patent [19]

Schon

[11] Patent Number: 5,460,215

[45] Date of Patent: Oct. 24, 1995

[54] TENSIONABLE WINDOW CONVERING

[75] Inventor: Siegfried J. Schon, Meer, Belgium

[73] Assignee: Schon B.V., Breda, Netherlands

[21] Appl. No.: 137,068

[22] PCT Filed: Feb. 15, 1993

[86] PCT No.: PCT/NL93/00033

§ 371 Date: Mar. 29, 1994

§ 102(e) Date: Mar. 29, 1994

[87] PCT Pub. No.: WO93/16265

PCT Pub. Date: Aug. 19, 1993

[30] Foreign Application Priority Data

Feb. 14, 1992 [NL] Netherlands ..... 9200274

[51] Int. Cl.[6] ..... E06B 3/94

[52] U.S. Cl. ..... 160/84.06; 160/349.1; 160/178.1

[58] Field of Search ..... 160/84.1 E, 84.1 C, 160/84.1 D, 84.1 B, 168.1 R, 176.1 R, 172 R, 178.1 R, 349.1, 349.2, 328

[56] References Cited

U.S. PATENT DOCUMENTS

| | | | |
|---|---|---|---|
| 2,394,847 | 2/1946 | Delegard | 160/173 R |
| 2,759,537 | 8/1956 | Lang | 160/328 |
| 2,822,868 | 2/1958 | Roberts | 160/173 R |
| 2,880,797 | 4/1959 | Alvarez et al. | 160/328 |
| 2,901,035 | 8/1959 | Anderle | 160/178.1 R |
| 4,557,309 | 12/1985 | Judkins | 160/84.1 E |
| 4,733,711 | 3/1988 | Schon | 160/84.1 B |
| 5,069,264 | 12/1991 | Klawiter | 160/178.1 R |

FOREIGN PATENT DOCUMENTS

| | | |
|---|---|---|
| 0195483 | 9/1986 | European Pat. Off. . |
| 0388788 | 9/1990 | European Pat. Off. . |
| 6900897 | 9/1969 | Netherlands . |

*Primary Examiner*—David M. Purol

*Attorney, Agent, or Firm*—Ralph F. Crandell; Holland & Hart

[57] ABSTRACT

A tensioning, releasable mounting device (9) for a window covering structure mountable in a window recess (R) and including spaced apart beams (3, 4) supporting one or more tensioned cords (2) supporting and guiding a covering panel (1). The mounting device is mounted on each end of at least one beam, and is moveable between an active position, in which each cord (2) is tensioned, and a second position in which each cord (2) is slackened, so that the window covering is easily removed from the window recess.

14 Claims, 4 Drawing Sheets

TENSIONABLE WINDOW CONVERING

BACKGROUND OF THE INVENTION

1. Field of the Invention

The invention relates to a window covering. More particularly, the invention relates to a window covering mounted in a window recess and including spaced apart beams with one or more cord members tensioned therebetween for supporting and guiding a covering panel.

2. Background of the Invention

Window coverings can take different forms. A window covering can for instance be a pleated material or horizontally extending lamellar material. Such coverings are conventionally held in the plane between spaced rigid beams by one or more tensioning cords so that the covering also remains tautly suspended. Such coverings are useful in slanting windows such as skylights. Because of the tension on the tensioning cords it is difficult to remove the window covering in order, for example, to clean a glass window mounted in the window frame. See U.S. Pat. No. 4,733,711 issued Mar. 29, 1988, to S. Schön for "Folding Blind, Composite Folding Blind and Coupling Strip Therefore."

OBJECTS OF THE INVENTION

The principal object of the present invention is to provide an improved tensioned cord mounted window covering assembly which is easily released for removal from a window recess in which it is mounted and also rapidly inserted and mounted in the window recess with the cords reset to the correct tension.

Another object of the present invention is to provide an improved releasable mounting mechanism for tensioned cord mounted window covering assemblies.

SUMMARY OF THE INVENTION

A preferred embodiment of the invention is embodied in a tensioning and mounting device formed by an eccentric lever mechanism arranged on each end of one of the beams for tensioning the cords.

According to one embodiment of the invention, the tensioning and mounting eccentric lever mechanism is assembled on an auxiliary beam which is fixed to a main beam supporting the tensioning cords. At least one end face of the auxiliary beam is provided with a rotatable lever arm engagable with a bracket mounted in the window recess. After mounting the beam or beams on the other end of the window covering in the window recess, with or without the same eccentric mechanism, the auxiliary beam and therewith the main beam for tensioning can be secured in place at the correct tension cord position.

In order to enable easy removal of the covering and the beams, the lever arm co-acts with an anchor plate fastened against the window recess, which plate is provided with a hook-like recess in which the arm is detachably and rotatably supported.

The above construction according to the present invention also lends itself to arrangement of a second beam close to the main beam, such that both auxiliary beams can be protected at the upper and lower limits of the window recess. This offers the advantage particularly in the case of windows with great light incidence that a ventilation gap is created at either the top or bottom or both edges of the covering, whereby the temperature in the space between the window covering and the glass plate will not rise too high.

Above mentioned and other features of the invention will be further elucidated in the drawings and description of the invention.

DESCRIPTION OF THE PREFERRED EMBODIMENT

Figure 1:
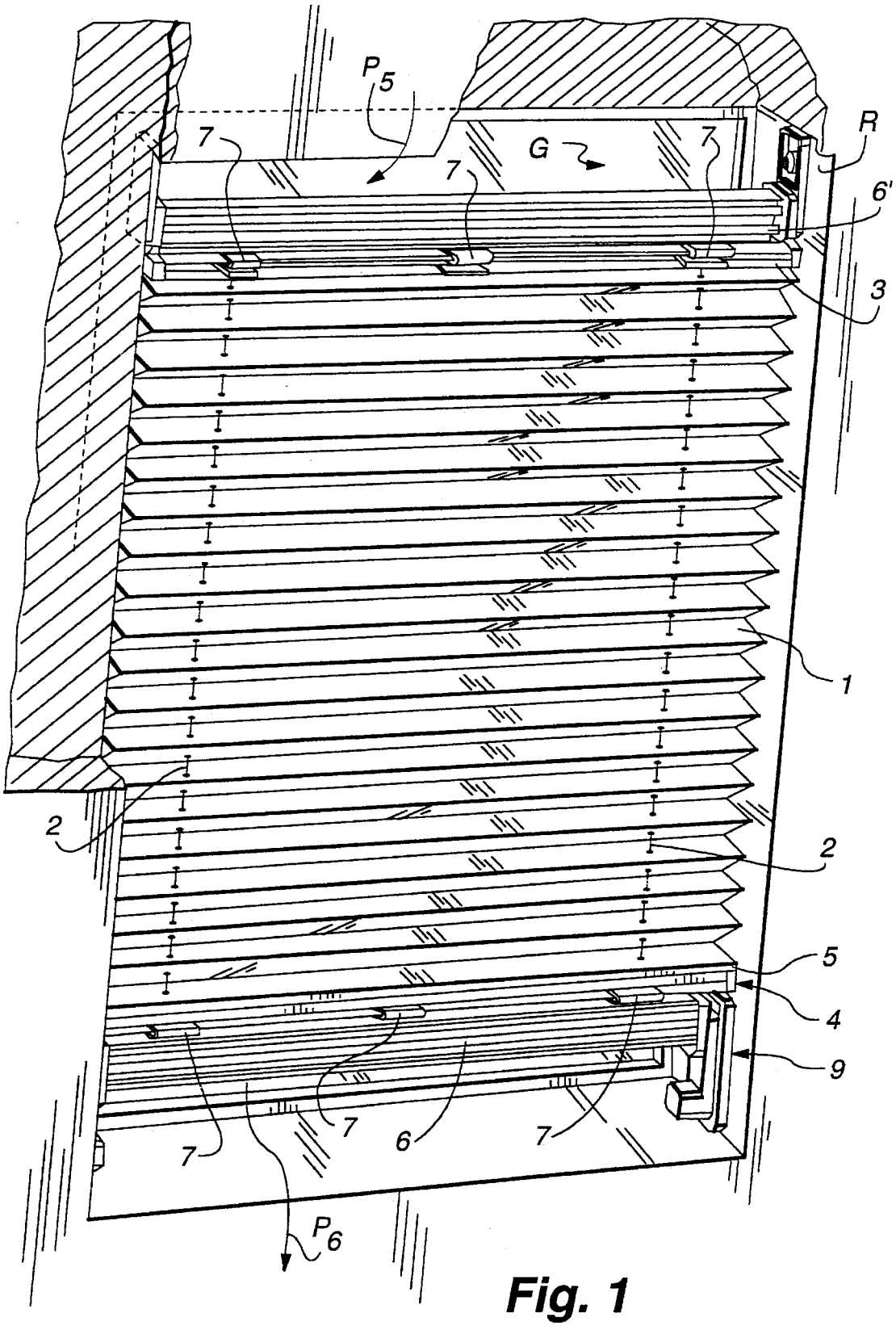
FIG. 1 shows a perspective view of a window covering in the form of a pleated material, provided respectively with the tensioning and eccentric mechanism according to the invention.
Figure 3:
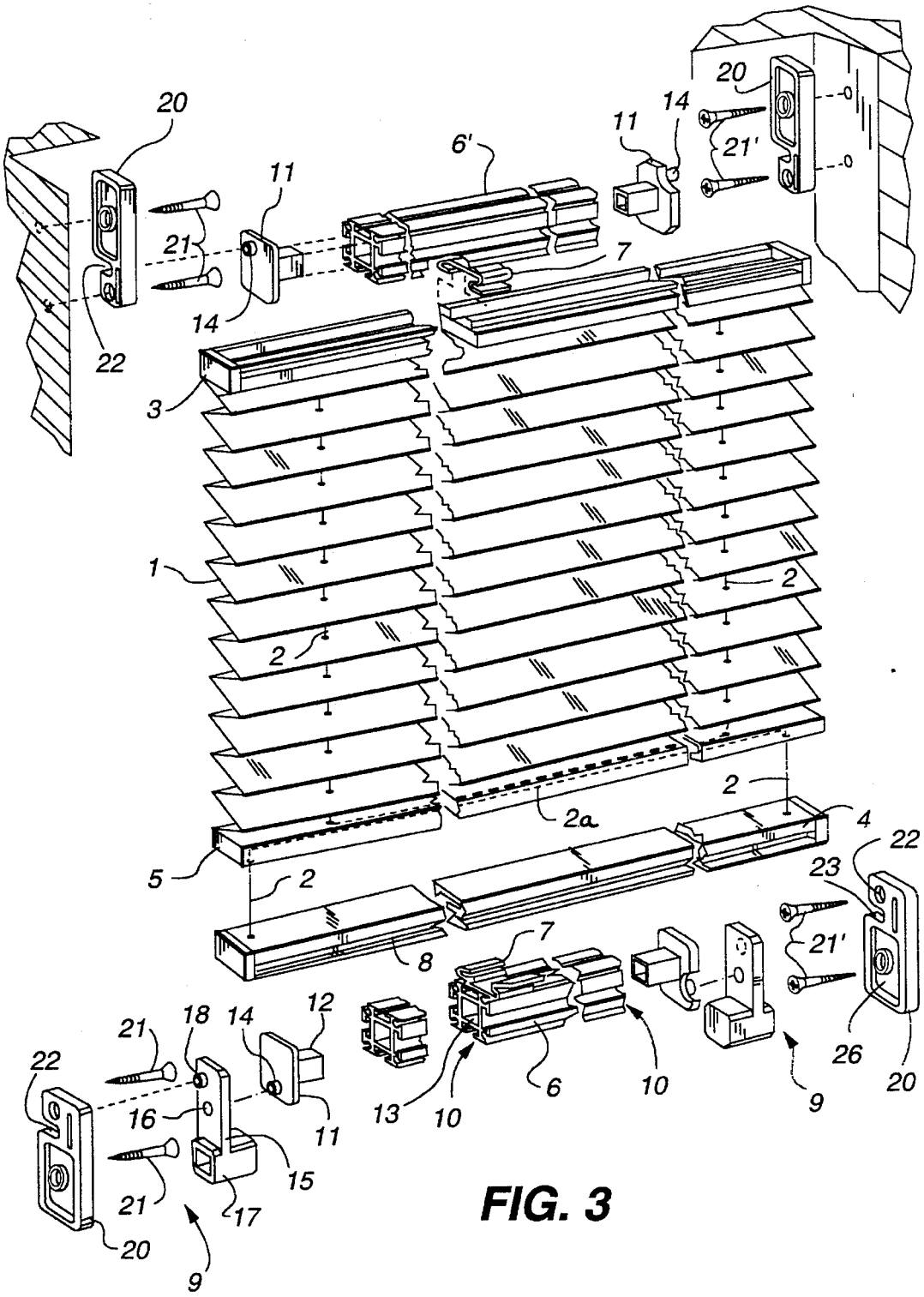
FIG. 3 is a perspective view corresponding with FIG. 1, but with the parts of the eccentric mechanism in exploded view.

Referring to FIG. 1, a window covering is formed by a pleated material 1 which consists of a length of material folded in zig-zag form and respectively guided and supported by tensioning cords 2 fastened between a first beam 3 secured to the top edge of the material 1 and a second beam 4 adjacent the bottom side of the material 1. A bottom tubular beam 5 is fixed to the bottom edge of the pleated material 1 and slidably mounted on the cords 2 so that the beam 5 can be moved upwardly or downwardly along the tensioning cords 2 as shown in FIG. 3. Such a construction of a window covering is generally known for pleated material curtains.

The window recess can have any appropriate configuration or shape. In the embodiment shown, the window recess R is defined by the periphery of a window frame F mounting a glass window plate G.

The beams 3 and 4 are tubular and the tensioning cords 2 are threaded in or secured thereto in a suitable manner as shown in FIG. 3. The cords 2 are held at the desired tension by tensioning means such as a draw spring **2*a* (FIG. 3) housed in the tubular sliding beam 5**.

One or both the second beam 4 and the first beam 3 are fixed to a respective auxiliary or mounting beam 6, 6' using spring clamps 7 fixed thereon. The clamps 7 are substantially U-shaped and have inwardly facing flanges which snap into grooves 8 of first beam 3 or second beam 4. The auxiliary beams 6, 6' may have any desired cross-section and are formed of a length which is slightly shorter than the length of the associated second beam 4 or first beam 3. Each end face 10 of an auxiliary beam 6, 6' is provided with a closing plate 11 having an extending boss or plug 12 which fits into the hollow end space 13 of the auxiliary beam 6, 6'. The closing plate 11 has a height which is greater than that of auxiliary beam 6, 6' to form an extension on which a mounting protrusion or pin 14 is formed, which pin extends axially from the end of the beam 6, 6'.

In accordance with the present invention, a releasable tensioning and mounting device 9 releasably mounts an auxiliary beam in the window recess. To this end, one of the beams 6 is provided at each end with a tensioning and mounting device 9 formed by a swingable toggle or lever arm 15 provided with a hole 16 that receives the pin 14 of the closing plate 11. The lever arm 15 is provided with a knob-like end portion or handle 17 which can be gripped to swing the lever arm on the pin 14. Arranged on the end of the lever arm 15 opposite from the pivot hole 16 is a projecting pin 18.

For mounting the window covering 1 in the window recess R, anchor plates 20 are fastened against the sides of the window frame F by screws 21. Each anchor plate 20 has an end portion defining a hook 22 forming a hook recess or slot 23 for receiving and holding an inserted pin 14, 18. The length of the auxiliary beam 6 with the closing plate 11 and lever arm 15 mounted thereon is such that the pins 18 engage the hooks 22 of the adjacent anchor plates 20.

The window covering 1 and associated mounting beams 6, 6' are mounted in a window recess R by engaging the pins 14 on the one beam 6' in the hook slots 23 of associated anchor plates 20. The first beam 6' is thereby mounted in the window recess R. The opposite mounting beam 6 is secured in the window recess by engaging the pins 18 of the swingable lever arm 15 in the hook slots 23 of the associated anchor plates 20 and then, by gripping the handle knobs 17, pivoting the lever arms to tension the cords 2 against the biasing force of the tensioning spring **2*a* and snap lock the mounting beam 6 into place. The second beam 4, being secured to the mounting beam 6 by the clips 7, is thereby mounted in the window recess R and the cords 2** tensioned.

To release the cord tension so that the second beam 4 and mounting beam 6 can easily be removed, the cords 2 are slackened by releasing the eccentric mechanism or lever arm 15. To this end, each lever arm 15 is swung away from the glass plate G (see FIG. 2) and rotated upward according to arrow P1. The pin 18 describes a circular path relative to pin 14, whereby the distance between the beam 6 and the first beam 3 becomes smaller. The cord 2 slackens and, in the slackened state, the pin 18 can be lifted from the recess 22 in the direction of the arrow P2 (see FIG. 2). One end of the window covering 1 is thus released from the window recess R and can be folded upward, whereafter the glass plate G becomes accessible.

Figure 2:
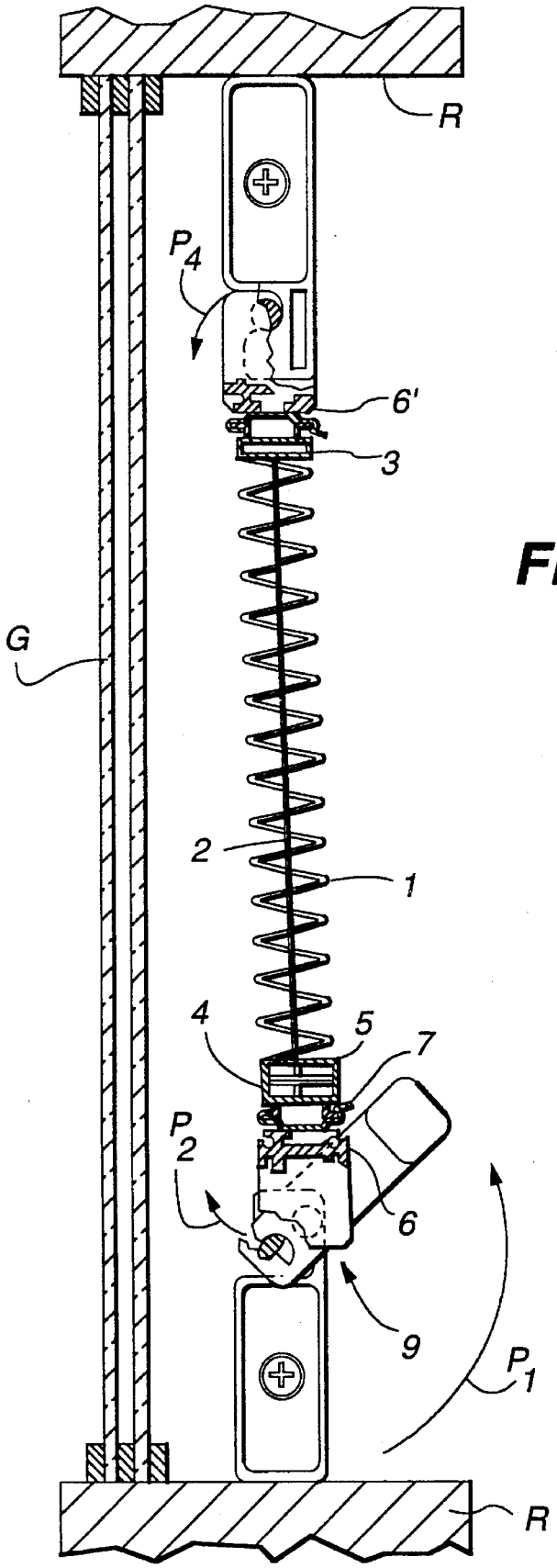
FIG. 2 shows a standing section of the window covering of FIG. 1.
Figure 4:
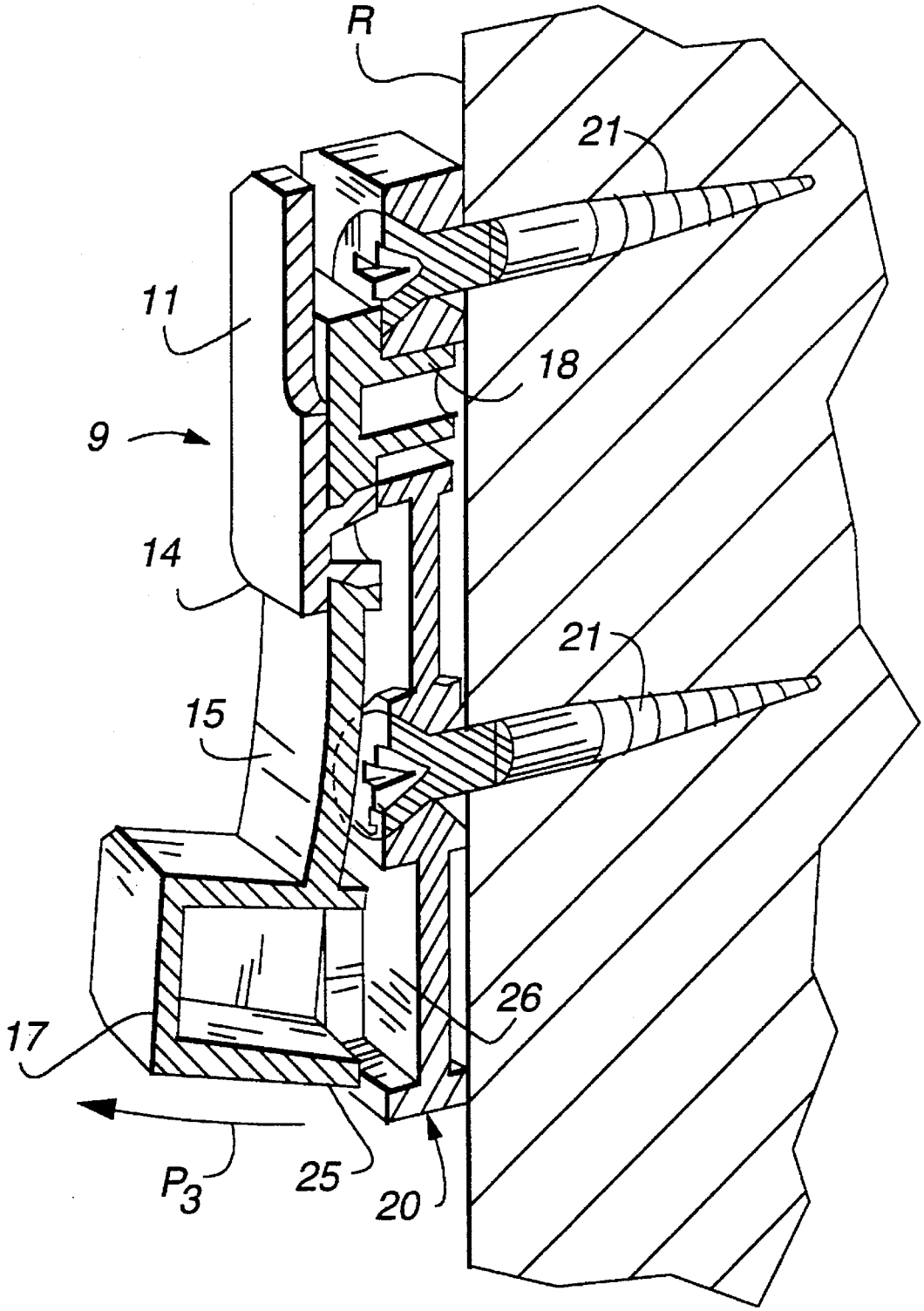
FIG. 4 is a perspective view on enlarged scale of the lever arm in the eccentric mechanism according to the invention.

In the embodiment shown it is possible to lock the lever arm 15 to the anchor plate 20, as shown in FIG. 4. For this purpose the knob-like portion 17 is extended on the side facing toward the anchor plate relative to the body plate of arm 15 to form an elongation or lip 25 which extends into an outwardly opening chamber or recess 26 defined on the anchor plate 20. By turning or bending the knob or handle 17 away from the anchor plate 20, in the direction of arrow P3, which is possible because of the relatively thin, stiffly bendable body plate of arm 15, the arm 15 is released and can then be rotated in the manner described above. Conversely, re-locking takes place by snapping the protruding lip 25 into the chamber or recess 26. The top beam 6' with the first beam 3 fixed thereto can be detached from the window frame by lifting the pins 14 out of the hook-like recesses 22, in the direction of arrow P4 as shown in FIG. 2.

Alternatively, the first beam 3 can be mounted directly against the top boundary of the window recess R. It is further possible to have the eccentric lever 15 point not downward, as shown, but upward in the tensioned position of the second beam 4 so that the second beam 4 with the auxiliary beam 6 coupled thereto, lies directly against the bottom boundary of the window recess R whereby the window recess R is fully covered by the window covering.

Further, it is possible to mount the lever arm 15 and closing plate 14 directly onto the second beam 4 without adversely affecting the action of the eccentric mechanism.

I claim:

1. A window covering mountable in a window frame defining a window recess, comprising a flexible covering material, a first beam secured to said covering material and adapted to be secured to the window frame within the window recess, a second beam secured to said covering material at a point thereon spaced from said first beam and adapted to be releasably secured to the window frame within the window recess, a resiliently tensioned cord extending between said first and second beams for supporting and guiding said covering material between an extended position and a contracted position, and a tensioning member secured to said second beam for selectively positioning said second beam in either a first position in which said cord is tensioned to support said window covering or a second position in which said cord is slackened for release of said window covering from said frame.

2. A window covering as defined in claim 1, wherein said tensioning member includes an eccentric toggle mechanism.

3. A window covering as defined in claim 2, wherein said eccentric toggle mechanism includes a lever arm rotatably mounted on said second beam.

4. A window covering as defined in claim 3, further including an anchor plate fastenable to the window frame and having a hook operatively engageable with said lever arm.

5. A window covering as defined in claim 4, wherein said lever arm includes a locking member co-actable with a locking device on said anchor plate.

6. A window covering as defined in claim 3, further including a first mounting beam fixed to said first beam, said lever arm being mounted on at least one face of said first mounting beam for tensioning said cord.

7. A window covering as defined in claim 6, further including a second mounting beam attached to said second beam.

8. A window covering as defined in any one of the preceding claims, further including means releasably mounting said second beam in the window recess.

9. A window covering as defined in claim 7, wherein said first and second mounting beams include end closing plates each having a mounting pin rotatably engaging said lever arm extending therefrom.

10. A window covering as defined in claim 5 wherein said lever arm is stiffly bendable, and said locking member and said locking device comprise interengagable projections.

11. A window covering as defined in claim 5 wherein said locking member comprises a lip projecting outwardly from said lever arm and said locking device comprises means defining a recess on said anchor plate adapted to releasably receive and engage said lip.

12. A window covering as defined in claim 5 wherein said locking member comprises a projection on said lever arm and said locking device comprises a projection on said anchor plate adapted to be engaged by said lever arm projection, and said lever arm is stiffly bendable for selectively releasing and engaging said locking member and said locking device.

13. A tensioning and mounting device for mounting a tensioned cord window covering to a window frame, said tensioned cord window covering including a spaced apart pair of beams secured to a resiliently tensioned cord supporting a flexible covering material, said tensioning and mounting device comprising, in combination, a mounting plate adapted to be secured to the window frame and having a recess therein defining a hook, an end plate adapted to be secured to one end of a beam and having an outwardly projecting pivot pin thereon, an elongated lever arm pivotally mounted on said pin and having a lever arm pin projecting outwardly from at one end thereof and a handle projecting outwardly from the other end thereof, said lever arm pin being engagable with said mounting plate hook for securing said window covering in said frame and tensioning said cord when said lever arm is rotated relative to said beam, a lip on said lever arm extending outwardly from said handle end thereof in the direction of the pin thereon, and means defining a recess on said mounting plate for receiving and retaining said lip and thereby said lever arm.

14. A tensioning and mounting device for a tensioned cord window covering including a spaced apart pair of beams, a resiliently tensioned cord extending between said beams, and a covering material attached to said beams and supported on said cord, said device comprising a lever arm pivotally mounted at each end of at least one of said beams and adapted for rotation about a pivot axis, a pin extending outwardly from said lever arm at a point thereon spaced from said pivot axis, and an anchor plate defining a hook operatively engagable with said lever arm pin, whereby rotation of said lever arm with respect to said beam selectively secures said beam to said anchor plate while tensioning said cord.

* * * * *